US010365002B2

(12) United States Patent
Ino et al.

(10) Patent No.: US 10,365,002 B2
(45) Date of Patent: Jul. 30, 2019

(54) REMOTE CONTROLLER OF AIR-CONDITIONING SYSTEM

(71) Applicant: Mitsubishi Electric Corporation, Tokyo (JP)

(72) Inventors: Hiroyuki Ino, Tokyo (JP); Hidetoshi Muramatsu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/554,787

(22) PCT Filed: May 26, 2015

(86) PCT No.: PCT/JP2015/065132

§ 371 (c)(1),
(2) Date: Aug. 31, 2017

(87) PCT Pub. No.: WO2016/189665

PCT Pub. Date: Dec. 1, 2016

(65) Prior Publication Data

US 2018/0038608 A1 Feb. 8, 2018

(51) Int. Cl.
*F24F 11/00* (2018.01)
*F24F 11/30* (2018.01)
(Continued)

(52) U.S. Cl.
CPC ..... *F24F 11/62* (2018.01); *F24F 11/00* (2013.01); *F24F 11/30* (2018.01); *F24F 11/39* (2018.01); *F24F 11/56* (2018.01); *F24F 11/64* (2018.01)

(58) Field of Classification Search
CPC .. F24F 11/62; F24F 11/30; F24F 11/00; F24F 11/56; F24F 11/39; F24F 11/64
See application file for complete search history.

(56) References Cited

U.S. PATENT DOCUMENTS 4,996,643 A * 2/1991 Sakamoto ..... G01R 31/007 701/29.6
2009/0139251 A1* 6/2009 Masui ..... F25B 13/00 62/129
2012/0187201 A1 7/2012 Kawai

FOREIGN PATENT DOCUMENTS

EP 2 239 518 A2 10/2010
EP 2239518 A2 * 10/2010 ..... F24F 11/77
(Continued)

OTHER PUBLICATIONS

Extended European Search Report dated Feb. 8, 2017 for the corresponding EP application No. 15864299.1.
(Continued)

*Primary Examiner* — Edward F Landrum
*Assistant Examiner* — Chang H. Park
(74) *Attorney, Agent, or Firm* — Posz Law Group, PLC

(57) ABSTRACT

A remote controller of an air-conditioning system enables operation state diagnosing. A remote controller of an air-conditioning system having an outdoor device, and an indoor device connected to the outdoor device includes a communication unit that performs bidirectional communication with the indoor device in a wired or wireless manner, and a memory that has stored therein operation-state diagnosing tables for every operation mode that are used in maintenance and inspection of the air-conditioning system. An appropriate one of the operation-state diagnosing tables is used according to an operation mode and an operation time of the air-conditioning system.

6 Claims, 13 Drawing Sheets

(51) Int. Cl.

| | |
|---|---|
| ***F24F 11/39*** | (2018.01) |
| ***F24F 11/56*** | (2018.01) |
| ***F24F 11/62*** | (2018.01) |
| ***F24F 11/64*** | (2018.01) |

(56) References Cited

FOREIGN PATENT DOCUMENTS

| | | | |
|---|---|---|---|
| JP | 2003-161495 | A | 6/2003 |
| JP | 2003-172567 | A | 6/2003 |
| JP | 2008-057921 | A | 3/2008 |
| JP | 2010-210121 | A | 9/2010 |
| JP | 2013-174385 | A | 9/2013 |
| JP | 2014-158311 | A | 8/2014 |

OTHER PUBLICATIONS

International Search Report of the International Searching Authority dated Sep. 1, 2015 for the corresponding international application No. PCT/JP2015/065132 (and English translation).

* cited by examiner

FIG.5

OPERATION INFORMATION COLLECTED IN INSPECTION

| No. | ITEM |
|---|---|
| (1) | OUTDOOR DISCHARGE TEMPERATURE |
| (2) | OUTDOOR HEAT-EXCHANGE TEMPERATURE |
| (3) | INDOOR INTAKE TEMPERATURE |
| (4) | INDOOR HEAT-EXCHANGE TEMPERATURE |
| (5) | INDOOR-DEVICE OPERATION TIME |
| (6) | OUTDOOR-DEVICE OPERATION TIME |
| (7) | ... |

(1): OUTDOOR DISCHARGE TEMPERATURE
(2): OUTDOOR HEAT-EXCHANGE TEMPERATURE (3): INDOOR INTAKE TEMPERATURE
(4): INDOOR HEAT-EXCHANGE TEMPERATURE (1): OUTDOOR DISCHARGE TEMPERATURE
(2): OUTDOOR HEAT-EXCHANGE TEMPERATURE (3): INDOOR INTAKE TEMPERATURE
(4): INDOOR HEAT-EXCHANGE TEMPERATURE

COOLING OPERATION-STATE DIAGNOSING TABLE
IN CASE WHERE OPERATION TIME IS ABOVE FIRST SET TIME
AND IS EQUAL TO OR LESS THAN SECOND SET TIME (1): OUTDOOR DISCHARGE TEMPERATURE
(2): OUTDOOR HEAT-EXCHANGE TEMPERATURE (3): INDOOR INTAKE TEMPERATURE
(4): INDOOR HEAT-EXCHANGE TEMPERATURE (1): OUTDOOR DISCHARGE TEMPERATURE
(2): OUTDOOR HEAT-EXCHANGE TEMPERATURE (3): INDOOR INTAKE TEMPERATURE
(4): INDOOR HEAT-EXCHANGE TEMPERATURE

FIG.10

MAINTENANCE DATA RESULT

REFRIGERANT ADDRESS 0 COOLING

NORMALLY OPERATING

BACK TO PREVIOUS PAGE: BACK BUTTON

▽ PAGE △

DISPLAY ON REMOTE CONTROLLER SCREEN
IN NORMAL OPERATION

FIG.11

MAINTENANCE DATA RESULT

REFRIGERANT ADDRESS 0 COOLING

PERFORMANCE LOWERED
DETAILED INSPECTION REQUIRED

BACK TO PREVIOUS PAGE: BACK BUTTON

▽ PAGE △

DISPLAY ON REMOTE CONTROLLER SCREEN
IN INSPECTION A

REMOTE CONTROLLER OF AIR-CONDITIONING SYSTEM

CROSS REFERENCE TO RELATED APPLICATION

This application is a U.S. national stage application of International Patent Application No. PCT/JP2015/065132 filed on May 26, 2015, the disclosure of which is incorporated herein by reference.

TECHNICAL FIELD

The present invention relates to a remote controller of an air-conditioning system including an outdoor device and an indoor device.

BACKGROUND

Conventionally, an air-conditioning system that diagnoses an operation state of the air-conditioning system using an operation-state diagnosing table based on information on the operation state of the air-conditioning system collected by a remote controller, and that displays a diagnosing result on a display screen has been put into practical use to enable a maintenance-inspection person, that is, a service person to easily check the operation state of the air-conditioning system in inspection of the air-conditioning system.

Patent Literature 1, which is an example of a technique that compares a preset threshold value and a current state amount to perform a fault diagnosis, describes a problem that "a conventional fault diagnosis method for a refrigeration device grasps a state of the refrigeration device by comparing a threshold value set by accumulation of past data or a preset threshold value with the current state amount and, in order to perform a fault diagnosis in a refrigeration device with a compressor having a controllable performance mounted therein, it is necessary to change the threshold value every time a refrigeration performance changes or to preset the threshold value for each of refrigeration performances". Patent Literature 1 discloses a refrigeration device that "enables a fault diagnosis with high accuracy to be easily performed even in a case where the refrigerating performance is changed, by predicting normal input values of the refrigeration device and a compressor only from a current measurement value of the refrigeration device and comparing the predicted normal input values with actual measurement values of the input values".

PATENT LITERATURE

Patent Literature 1: Japanese Patent Application Laid-open. No. 2008-57921

However, according to the above described conventional technique, the operation-state diagnosing table for diagnosing the current operation state is not created in consideration of deterioration over time. The same operation-state diagnosing table continues to be used from the start of use without being updated. Therefore, although operation state diagnosing with high accuracy can be performed immediately after the start of use, the accuracy of the operation state diagnosing is lowered when the air-conditioning system deteriorates over time due to a long-term use.

SUMMARY

The present invention has been achieved in view of the above problems, and an object of the present invention is to provide a remote controller of an air-conditioning system that enables operation state diagnosing with high accuracy even after a long-term use.

To solve the above described problem and achieve the object a remote controller of an air-conditioning system including an outdoor device, and an indoor device connected to the outdoor device, the remote controller includes: a communication unit capable of performing bidirectional communication with the indoor device in a wired or wireless manner; and a memory that has stored therein a plurality of operation-state diagnosing tables for every operation mode that are used in maintenance and inspection of the air-conditioning system. An appropriate one of the operation-state diagnosing tables is used according to an operation mode and an operation time of the air-conditioning system.

Advantageous Effects of Invention

The remote controller of an air-conditioning system according to the present invention can provide a remote controller of an air-conditioning system that enables operation state diagnosing with high accuracy even after a long-term use.

BRIEF DESCRIPTION OF DRAWINGS

FIG. 5 is a diagram illustrating an example of items of operation information collected in inspection by the remote controller according to the first embodiment.

FIG. 10 is a diagram illustrating an example of a screen that displays a result of the operation state diagnosing in a normal operation in a case where the operation time is equal to or less than the first set time in the first embodiment.

FIG. 11 is a diagram illustrating an example of a screen that displays a result of the operation state diagnosing when an abnormality occurs in a case where the operation time is equal to or less than the first set time in the first embodiment.

DETAILED DESCRIPTION

Exemplary embodiments of a remote controller of an air-conditioning system according to the present invention will be explained below in detail with reference to the accompanying drawings. The present invention is not limited to the embodiments.

First Embodiment

Figure 1:
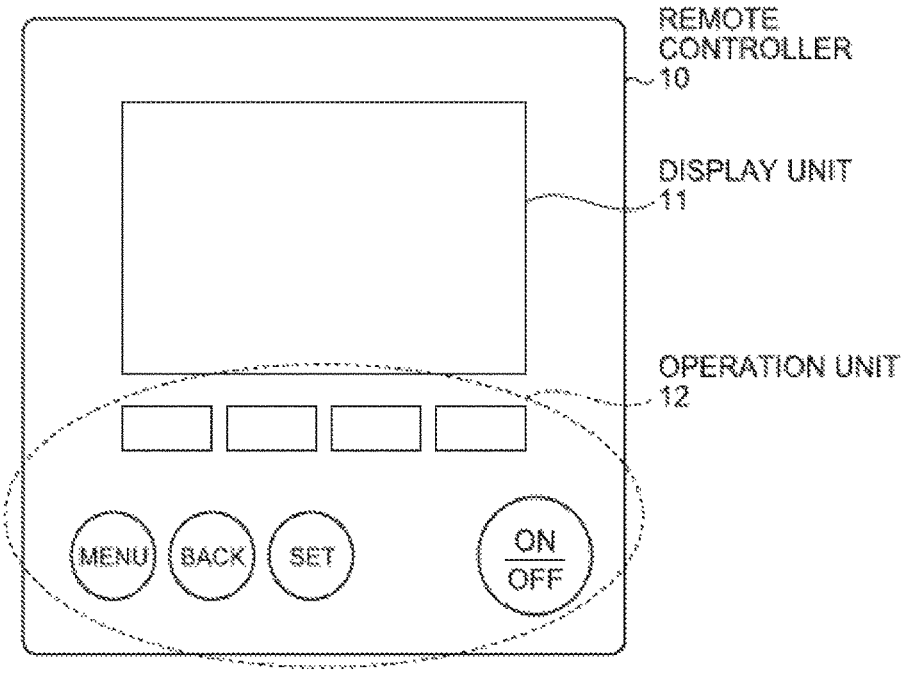
FIG. 1 is a diagram illustrating an example of an external configuration of a remote controller according to a first embodiment.

FIG. 1 is a diagram illustrating an example of an external configuration of a remote controller according to a first embodiment of the present invention. A remote controller 10 illustrated in FIG. 1 includes a display unit 11 that displays an operation state typified by a set temperature and an operation mode, and an operation unit 12 that includes various types of operation buttons typified by an ON-OFF switch button and a menu button. However, the present invention is not limited thereto. An operation display unit may be provided instead of the display unit and the operation unit. The operation display unit may be implemented by a touch panel.

Figure 2:
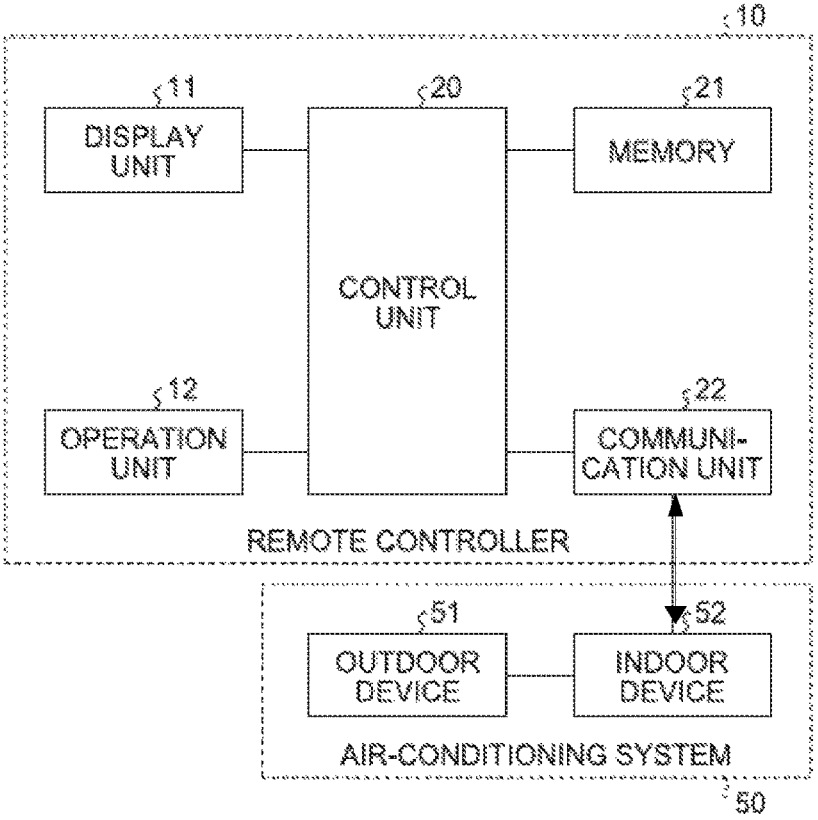
FIG. 2 is a block diagram illustrating a configuration example of the remote controller according to the first embodiment.
Figure 15:
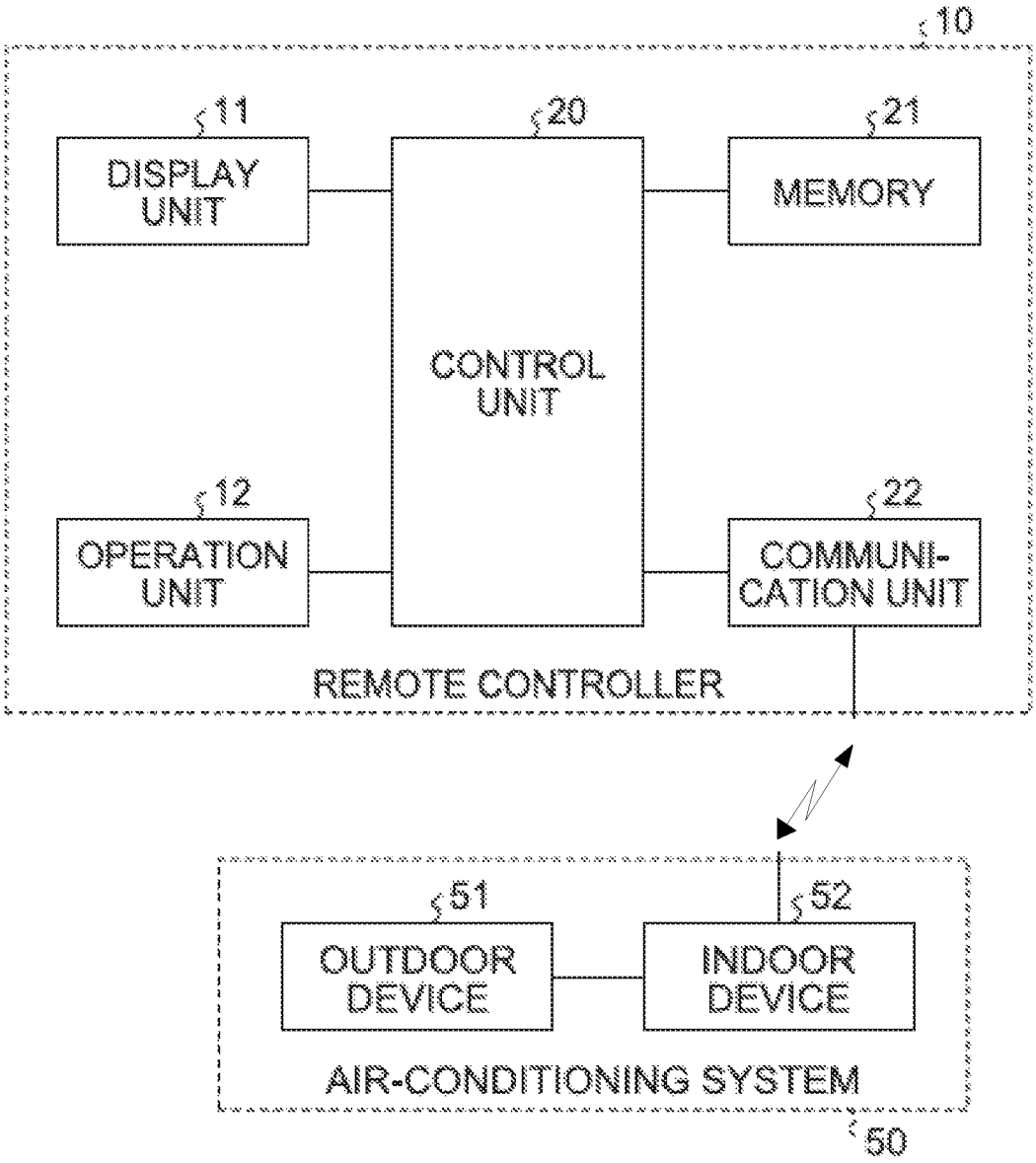
FIG. 15 is a block diagram of FIG. 2 with wireless communication.

FIG. 2 is a block diagram illustrating a configuration example of the remote controller according to the first embodiment of the present invention. The remote controller 10 illustrated in FIG. 2 includes the display unit 11, the operation unit 12, a control unit 20, a memory 21, and a communication unit 22. The display unit 11, the operation unit 12, the memory 21, and the communication unit 22 are connected to the control unit 20. The control unit 20 is implemented by a microcomputer and is a processor controlling an operation of the remote controller 10. The communication unit 22 is configured to perform bidirectional communication with an indoor device 52 of an air-conditioning system 50 in a wired or wireless (see FIG. 15) manner. An outdoor device 51 and the indoor device 52 constitute a portion of the air-conditioning system 50 that is controlled by the remote controller 10. The memory 21 includes a non-volatile memory and stores therein a plurality of operation-state diagnosing tables used at least in maintenance and inspection of the air-conditioning system. The operation-state diagnosing tables are tables used for extracting necessary inspection items from the operation state of the air-conditioning system.

Figure 3:
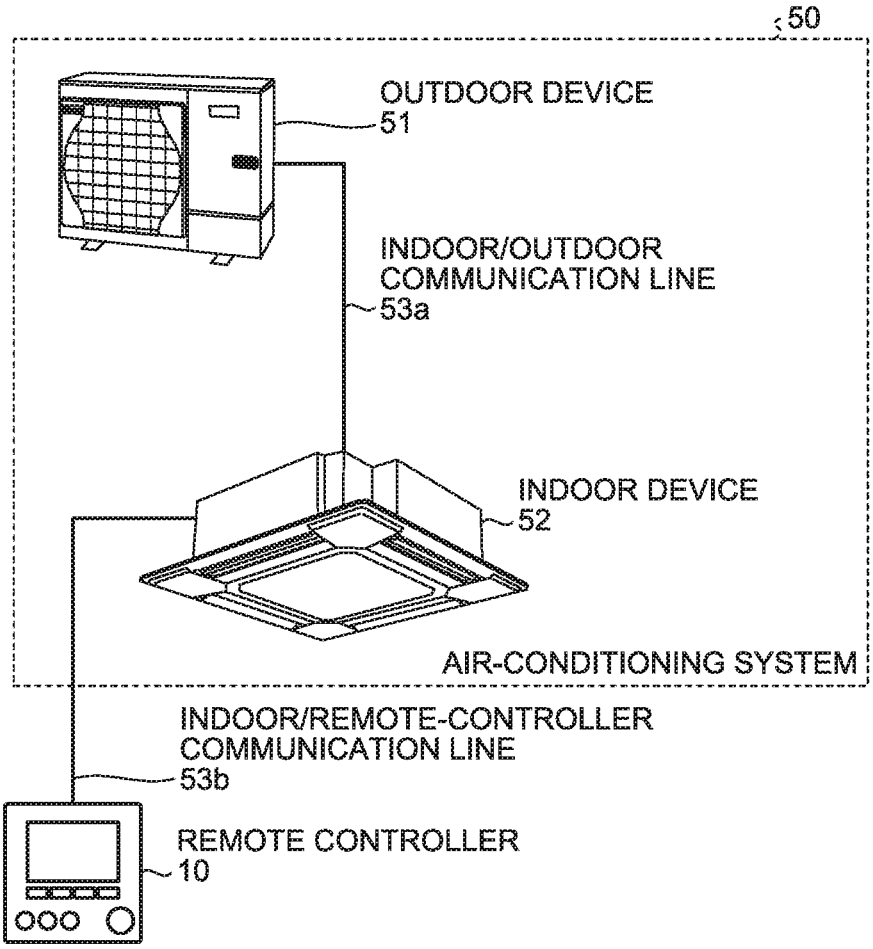
FIG. 3 a diagram illustrating a configuration example of the remote controller according to the first embodiment, and an air-conditioning system to which the remote controller is connected.

FIG. 3 is a diagram illustrating a configuration example of the remote controller according to the first embodiment of the present invention, and the air-conditioning system to which the remote controller is connected. The air-conditioning system 50 to which the remote controller 10 is connected, illustrated in FIG. 3, includes the outdoor device 51, the indoor device 52, an indoor-outdoor communication line 53*a* connecting the outdoor device 51 and the indoor device 52, and an indoor-remote-controller communication line 53*b* connecting the indoor device 52 and the remote controller 10. Although a case where the indoor-remote-controller communication line 53*b* connects the indoor device 52 and the remote controller 10 is illustrated here as an example, the present invention is not limited thereto. The remote controller 10 may be a wireless remote controller.

Figure 4:
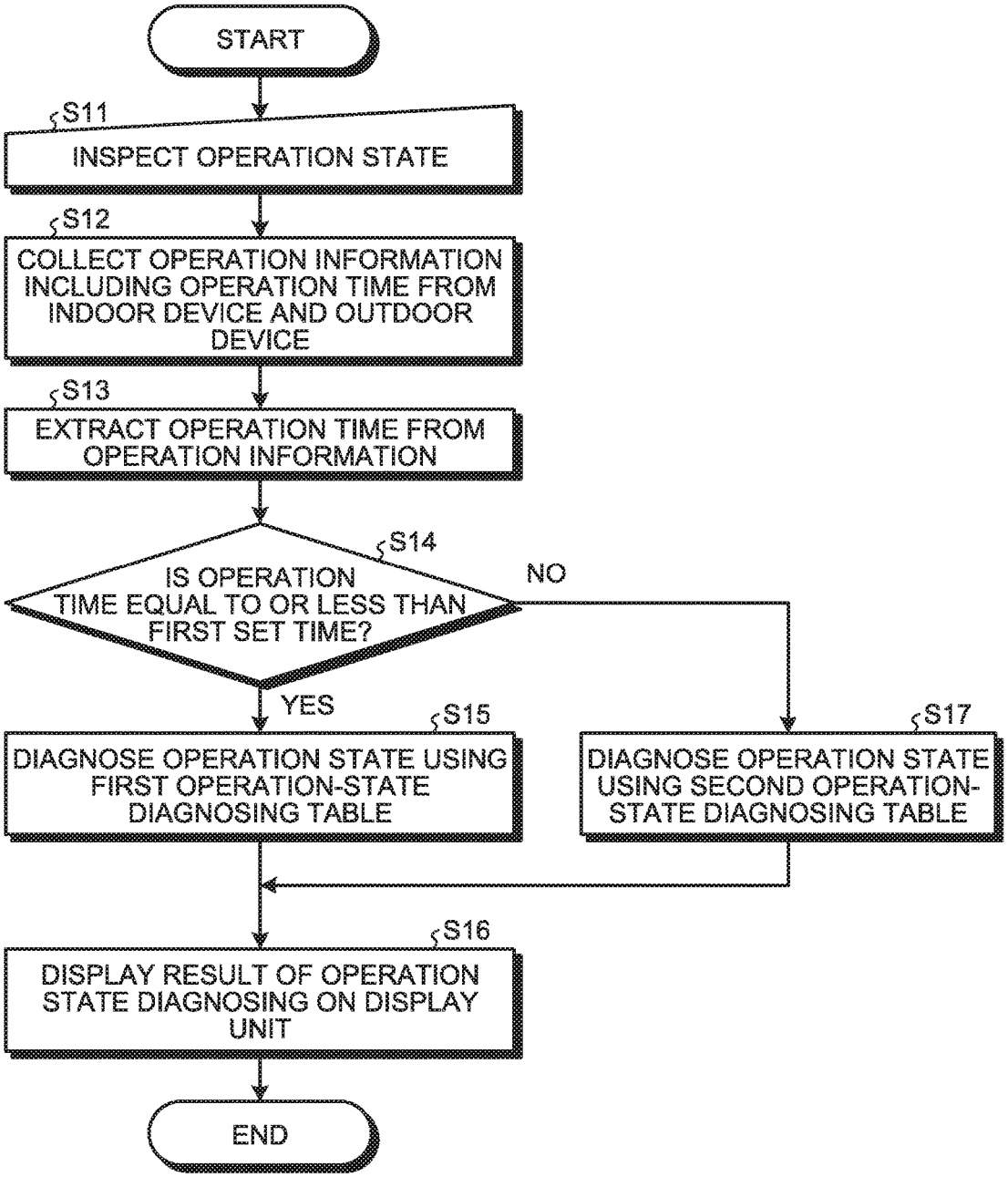
FIG. 4 is a diagram illustrating an example of a flowchart of operation state diagnosing by the remote controller according to the first embodiment.

FIG. 4 is a diagram illustrating an example of a flowchart of operation state diagnosing by the remote controller according to the first embodiment of the present invention. A maintenance-inspection person or a user inspects an operation state by operating the operation unit 12 of the remote controller 10, using an operation-state diagnosing table for a period until an indoor-device operation time and an outdoor-device operation time reach set times in the air-conditioning system 50 illustrated in FIG. 3 (S11). The remote controller 10 then collects operation information including the operation times from the outdoor device 51 and the indoor device 52 via the indoor/remote-controller communication line 53*b* (S12). The indoor-device operation time and the outdoor-device operation time are assumed to be equal to each other in the first embodiment for the sake of convenience and there may be a case simply referred to as "operation time".

FIG. 5 is a diagram illustrating an example of the items of the operation information collected in inspection by the remote controller according to the first embodiment of the present invention. FIG. 5 illustrates "outdoor discharge temperature", "outdoor heat-exchange temperature", "indoor intake temperature", "indoor heat-exchange temperature", "indoor-device operation time", and "outdoor-device operation time" as the items, to which numbers (1) to (6) are given in that order, respectively. In FIG. 5, (7) indicates that another item may be included because the above described items are merely examples. In this example, "outdoor discharge temperature" is a temperature of air discharged from the outdoor device, "indoor intake temperature" is a temperature of air taken in by the indoor device, "outdoor heat-exchange temperature" is a temperature of a heat exchanger included in the outdoor device, and "indoor heat-exchange temperature" is a temperature of a heat exchanger included in the indoor device.

The remote controller 10 extracts the operation time that is the indoor-device operation time and the outdoor-device operation time from the collected operation information (S13), and then determines an operation-state diagnosing table to be used based on the operation time that is the indoor-device operation time and the outdoor-device operation time. More specifically, the remote controller 10 determines whether the operation time is equal to or less than a first set time (S14), and uses an appropriate one of the operation-state diagnosing tables in accordance with a result of the above described determination.

Figure 6:
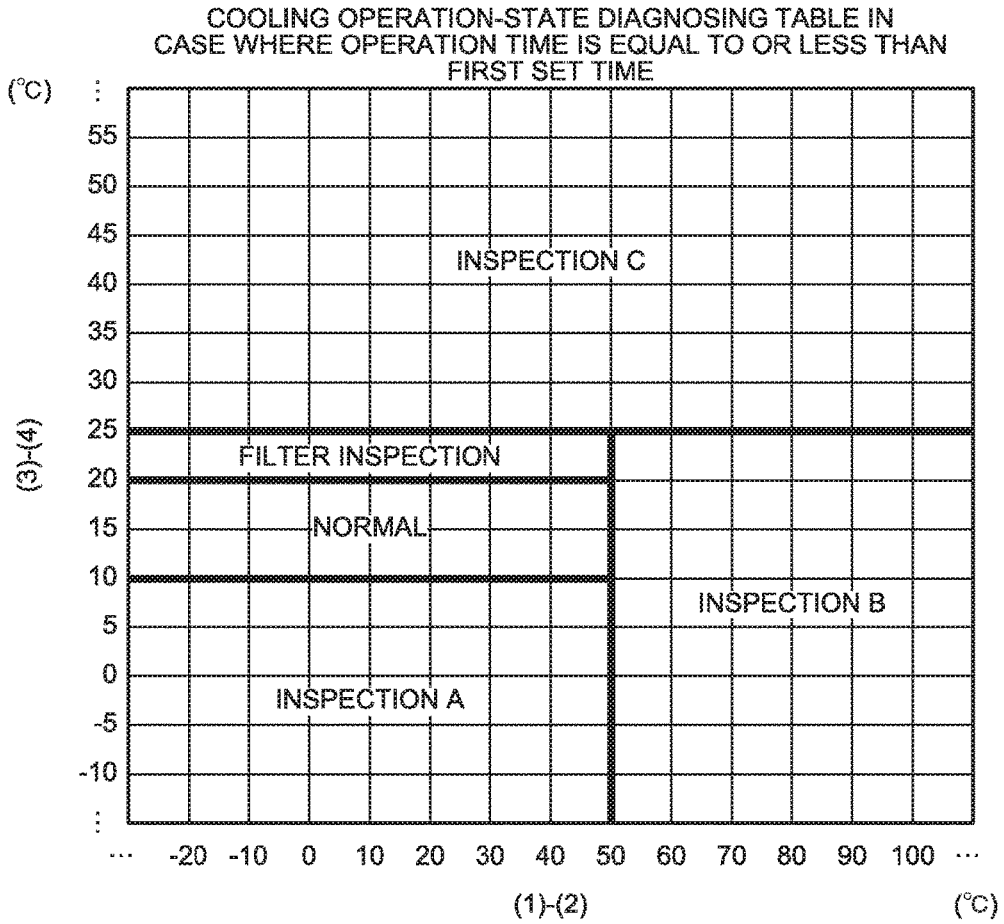
FIG. 6 is a diagram illustrating an example of a cooling operation-state diagnosing table stored in a memory of the remote controller according to the first embodiment, in a case where an operation time is equal to or less than a first set time.
Figure 7:
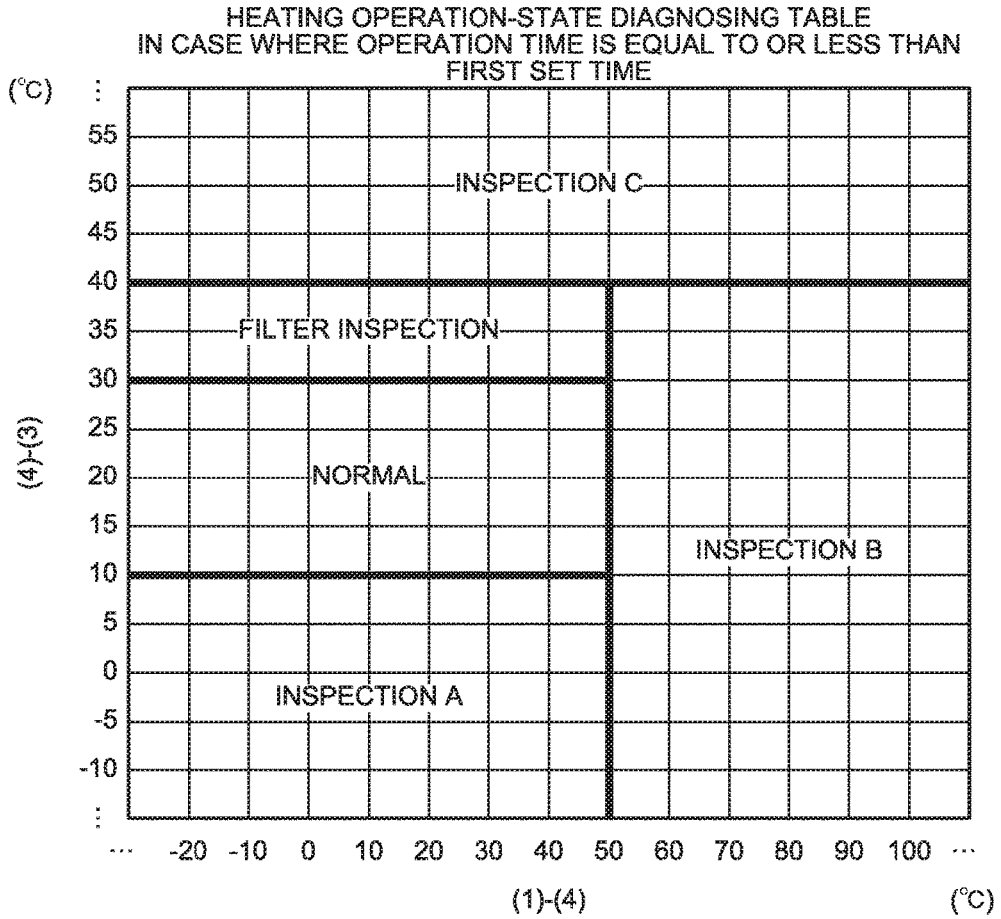
FIG. 7 is a diagram illustrating an example of a heating operation-state diagnosing table stored in the memory of the remote controller according to the first embodiment, in a case where the operation time is equal to or less than the first set time.
Figure 8:
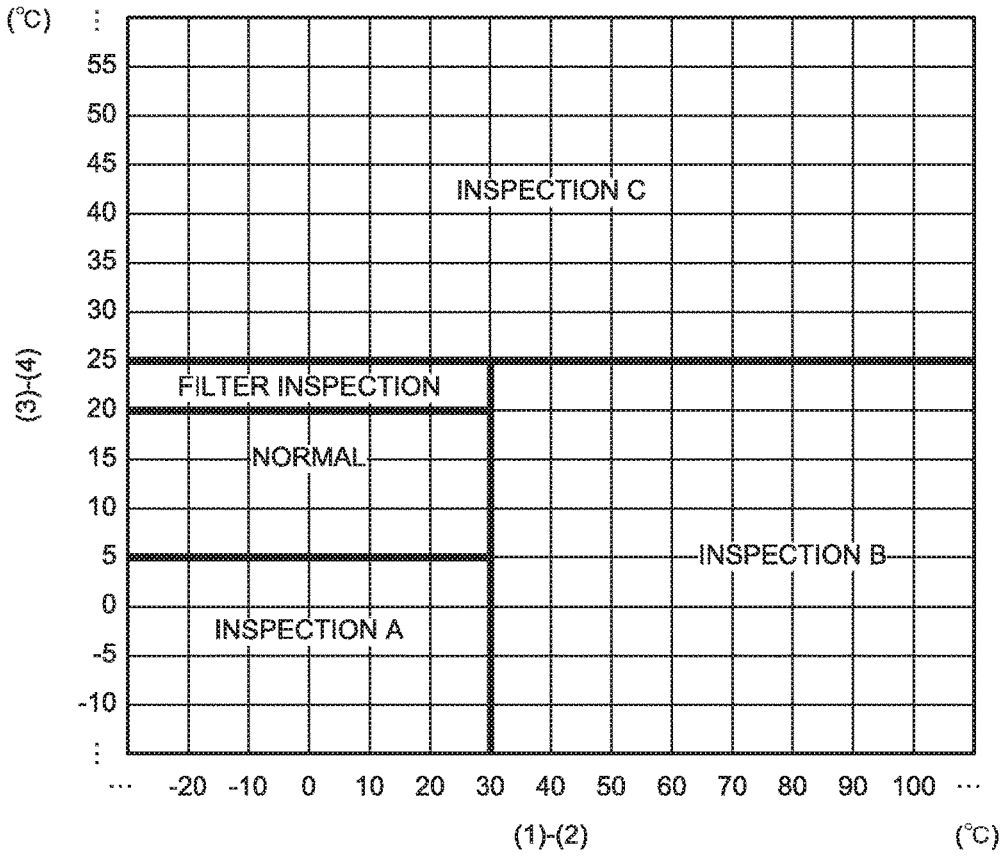
FIG. 8 is a diagram illustrating an example of a cooling operation-state diagnosing table stored in the memory of the remote controller according to the first embodiment, in a case where the operation time is above the first set time and is equal to or less than a second set time.
Figure 9:
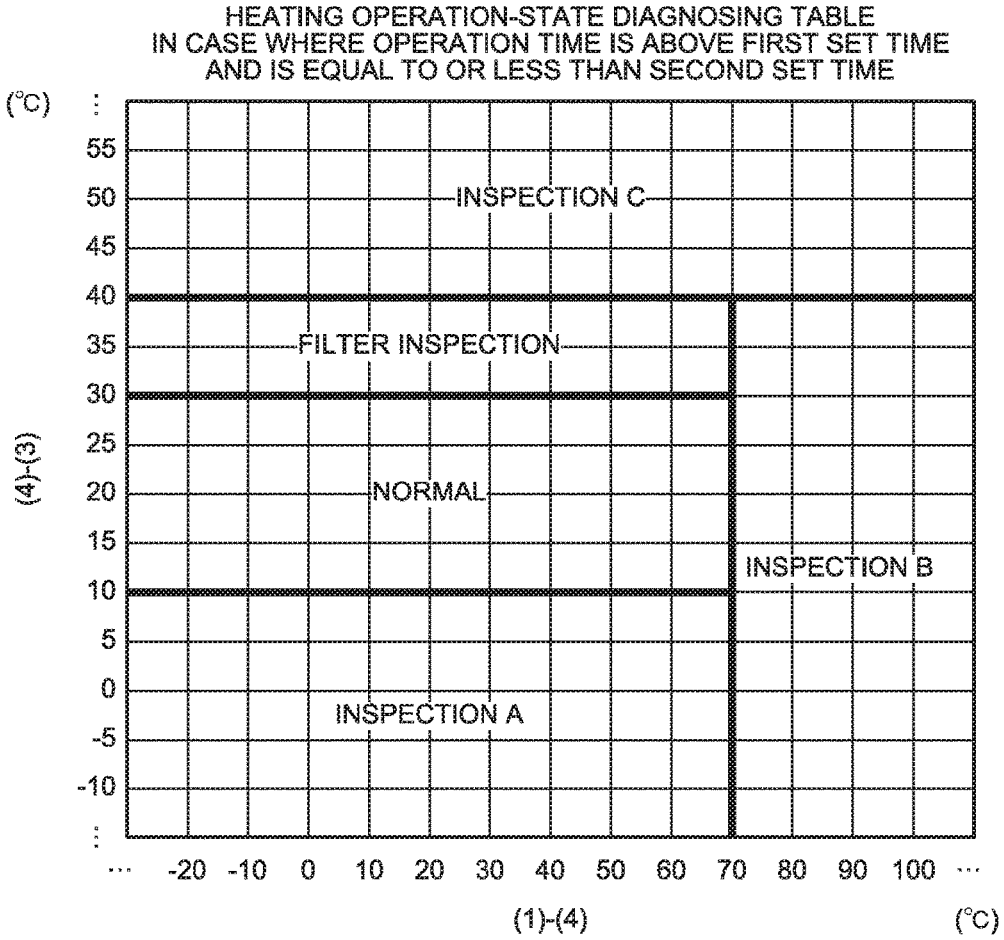
FIG. 9 is a diagram illustrating an example of a heating operation-state diagnosing table stored in the memory of the remote controller according to the first embodiment, in a case where the operation time is above the first, set time and is equal to or less than the second set time.

FIG. 6 is a diagram illustrating an example of a cooling operation-state diagnosing table stored in the memory of the remote controller according to the first embodiment of the present invention, in a case where the operation time is equal to or less than the first set time. FIG. 7 is a diagram illustrating an example of a heating operation-state diagnosing table stored in the memory of the remote controller according to the first embodiment of the present invention, in a case where the operation time is equal to or less than the first set time. FIG. 8 is a diagram illustrating an example of a cooling operation-state diagnosing table stored in the memory of the remote controller according to the first embodiment of the present invention, in a case where the operation time is above the first set time and is equal to or less than a second set time. FIG. 9 is a diagram illustrating an example of a heating operation-state diagnosing table stored in the memory of the remote controller according to the first embodiment of the present invention, in a case where the operation time is above the first set time and is equal to or less than the second set time. In this manner, the memory 21 of the remote controller 10 includes a plurality of operation-state diagnosing tables during cooling and a plurality of operation-state diagnosing tables during heating. That is, the memory 21 includes a plurality of operation-state diagnosing tables for every operation mode. In FIGS. 6 and 6, the horizontal axis represents a difference obtained by subtracting the outdoor heat-exchange temperature from the outdoor discharge temperature, and the vertical axis represents a difference obtained by subtracting the indoor heat-exchange temperature from the indoor intake temperature. In FIGS. 7 and 9, the horizontal axis represents a difference obtained by subtracting the indoor heat-exchange temperature from the outdoor discharge temperature, and the vertical axis represents a difference obtained by subtracting the indoor intake temperature from the indoor heat-exchange temperature.

In FIGS. 6, 7, 8, and 9, an area of "normal" indicates that the operation of the air-conditioning system 50 is normal, an area of "filter inspection" indicates a state where a filter included in the air-conditioning system 50 needs to be inspected, and areas of "inspection A", "inspection B", and "inspection C" indicate states where some predetermined inspection needs to be performed for the air-conditioning system 50. In a case where the difference obtained by subtracting the outdoor heat-exchange temperature from the outdoor discharge temperature is 20 and the difference obtained by subtracting the indoor heat-exchange temperature from the indoor intake temperature is 15, for example, it is determined that the air-conditioning system 50 is operating normally.

When the operation time is equal to or less than the first set time (YES at S14), operation state diagnosing is performed using a first operation-state diagnosing table (S15). That is, the operation state diagnosing is performed using the cooling operation-state diagnosing table illustrated in FIG. 6 for the cooling operation and the heating operation-state diagnosing table illustrated in FIG. 7 for the heating operation. When the operation time is above the first set time (NO at S14), the operation state diagnosing is performed using a second operation-state diagnosing table (S17). That is, the operation state diagnosing is performed using the cooling operation-state diagnosing table illustrated in FIG. 8 for the cooling operation and the heating operation-state diagnosing table illustrated in FIG. 9 for the heating operation. The second operation-state diagnosing table is a table used when the operation time is above the first set time and is equal to or less than the second set time.

The result of this operation state diagnosing is displayed on the display unit 11 of the remote controller 10 irrespective of branching at S14 (S16). FIG. 10 is a diagram illustrating an example of a screen that displays a result of the operation state diagnosing in a normal operation in a case where the operation time is equal to or less than the first set time. In FIG. 10, it is displayed that the air-conditioning system 50 is operating normally. FIG. 11 is a diagram illustrating an example of the screen that displays a result of the operation state diagnosing when an abnormality occurs in a case where the operation time is equal to or less than the first set time. In FIG. 11, it is displayed on the display screen that detailed inspection is required. The detailed inspection described here is an inspection for a portion of the abnormality displayed by the operation state diagnosing, which is performed manually by the maintenance-inspection person or the user. An example of the detailed inspection is inspection in which the filter is detached from the air-conditioning system and is visually checked when the operation state diagnosing is a "filter inspection". In the example described here, the air-conditioning system includes a plurality of indoor devices and a maintenance data result in an indoor device with "refrigerant address 0", which is one of the indoor devices, is illustrated.

A more specific example is described in which the first set time is two years. When the operation state diagnosing is performed one year after installation of the air-conditioning system 50, the operation state is diagnosed using the cooling operation-state diagnosing table illustrated in FIG. 6 or the heating operation-state diagnosing table illustrated in FIG. 7, which is the first operation-state diagnosing table. When the operation state diagnosing is performed three years after the installation of the air-conditioning system 50, the operation state is diagnosed using the cooling operation-state diagnosing table illustrated in FIG. 8 or the heating operation-state diagnosing table illustrated in FIG. 9, which is the second operation-state diagnosing table.

In the first embodiment, two kinds of operation-state diagnosing tables are provided for each of cooling and heating. However, the present invention is not limited thereto. When the capacity of the memory 21 of the remote controller 10 is large, the present invention may be configured in such a manner that the set times are more finely divided to use three or more kinds of operation-state diagnosing tables as appropriate in each operation mode.

As described in the first embodiment, a plurality of operation-state diagnosing tables are stored in the memory of the remote controller to be used as appropriate in accordance with the operation mode and the operation time of the air-conditioning system. Then, it is determined whether the current operation times of the indoor device and the outdoor device are equal to or less than set operation-time threshold values, respectively, and the operation-state diagnosing tables stored in the memory of the remote controller can automatically be switched based on the result of this determination. This configuration enables the operation state diagnosing to be conducted with a high degree of accuracy even after a long-term use.

Second Embodiment

The operation-state diagnosing tables described in the first embodiment are created from test data, without considering an installation environment and an operation situation, such as an installation condition or a temperature condition. Therefore, in a case where the installation environment and the operation situation are different from those assumed at the time of acquisition of the test data, for example, in a case where the air-conditioning system is installed in a server room in which cooling is used throughout the year even in winter, it is not appropriate to use the operation-state diagnosing tables described in the first embodiment because the installation environment and the operation situation may be deviated from those assumed at the time of acquisition of the test data. In a second embodiment of the present invention, an embodiment will be described in which the operation-state diagnosing tables are corrected to enable operation state diagnosing with a high degree of accuracy even in a case where the installation environment and the operation situation are different from those assumed at the time of acquisition of the test data.

Figure 12:
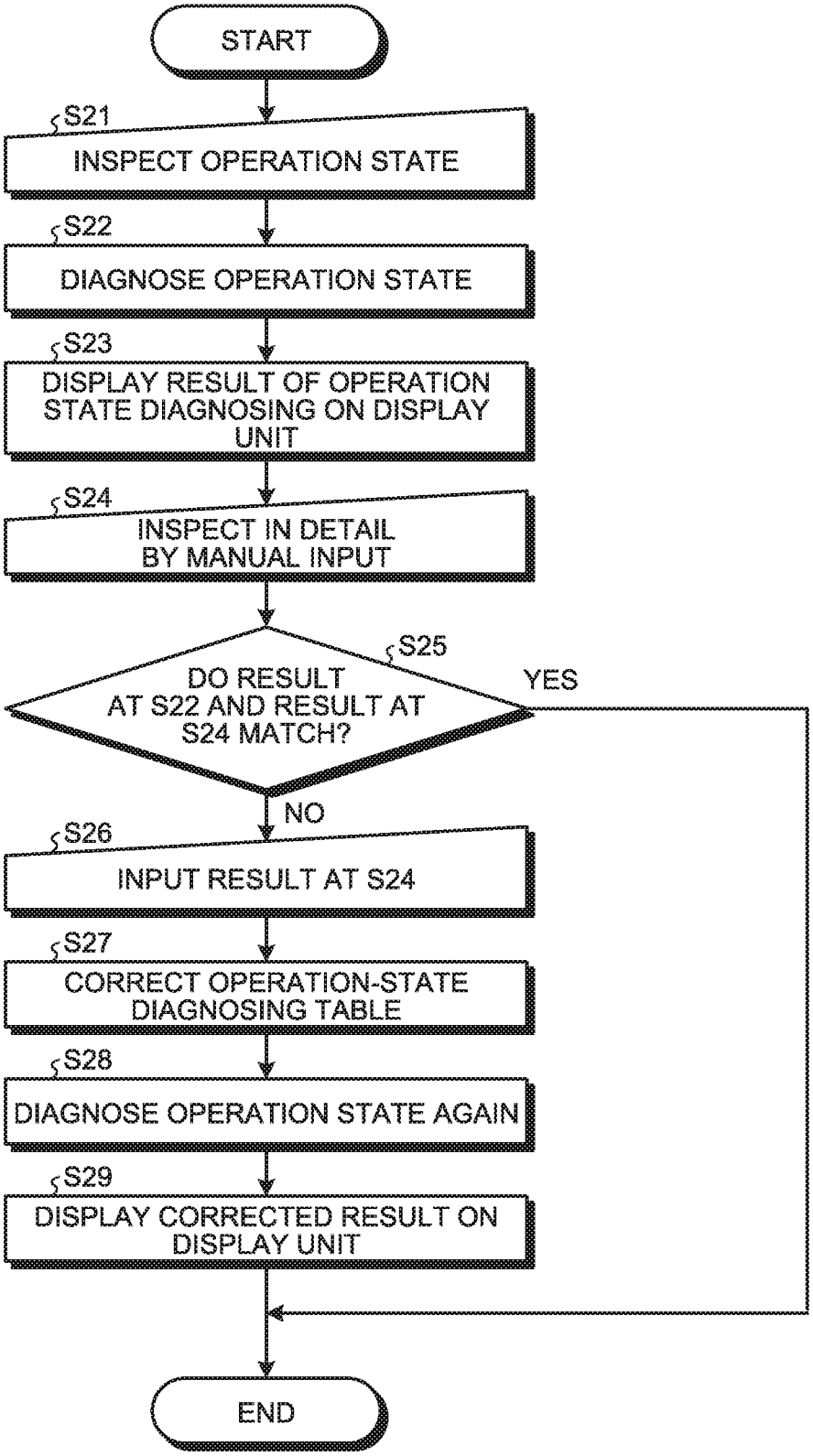
FIG. 12 is a diagram illustrating an example of a flowchart of operation state diagnosing by a remote controller according to a second embodiment.

FIG. 12 is a diagram illustrating an example of a flowchart of operation state diagnosing by a remote controller according to the second embodiment. First, the remote controller 10 inspects an operation state by an operation of the remote controller 10, as in the first embodiment (S21). The remote controller 10 diagnoses the operation state from operation information collected in association with the inspection of the operation state (S22) and displays a result of the operation state diagnosing on the display unit 11 (S23).

Subsequently, detailed inspection by manual input, that is, inspection by a manual operation by a maintenance-inspection person or a user is performed for a portion of an abnormality displayed by the operation state diagnosing (S24), and the remote controller 10 determines whether the result obtained at S22 and the result obtained at S24 match each other (S25). When the result at S22 and the result at S24 match each other as a result of the determination at S25 (YES at S25), the operation is ended. When the result at S22 and the result at S24 do not match each other (NO at S25), the remote controller 10 prompts input of the result at S24 to the remote controller 10, so that the result at S24 is input to the remote controller 10 (S26). The remote controller 10 corrects the operation-state diagnosing table based on the result at S24 input at S26 (S27), and performs the operation state diagnosing again as in the same manner as that at S22 (S28). The remote controller 10 then displays the corrected result on the display unit 11 (S29). In a case where the diagnosing result is "normal" at S22 and the result is "normal" in the detailed inspection at S24 with no abnormality found, or a case where the diagnosis result is "filter inspection" at S22 and the detailed inspection at S24 shows that the filter is actually clogged, it can be said that the result at S22 and the result at S24 match each other. However, in a case where the diagnosing result is "normal" at S22 while the detailed inspection at S24 shows that the filter is actually clogged, or a case where the diagnosis result is "filter inspection" at S22 while the inspection result is "normal" in the detailed inspection at S24 with no abnormality found, the result at S22 and the result at S24 do not match each other.

Figure 13:
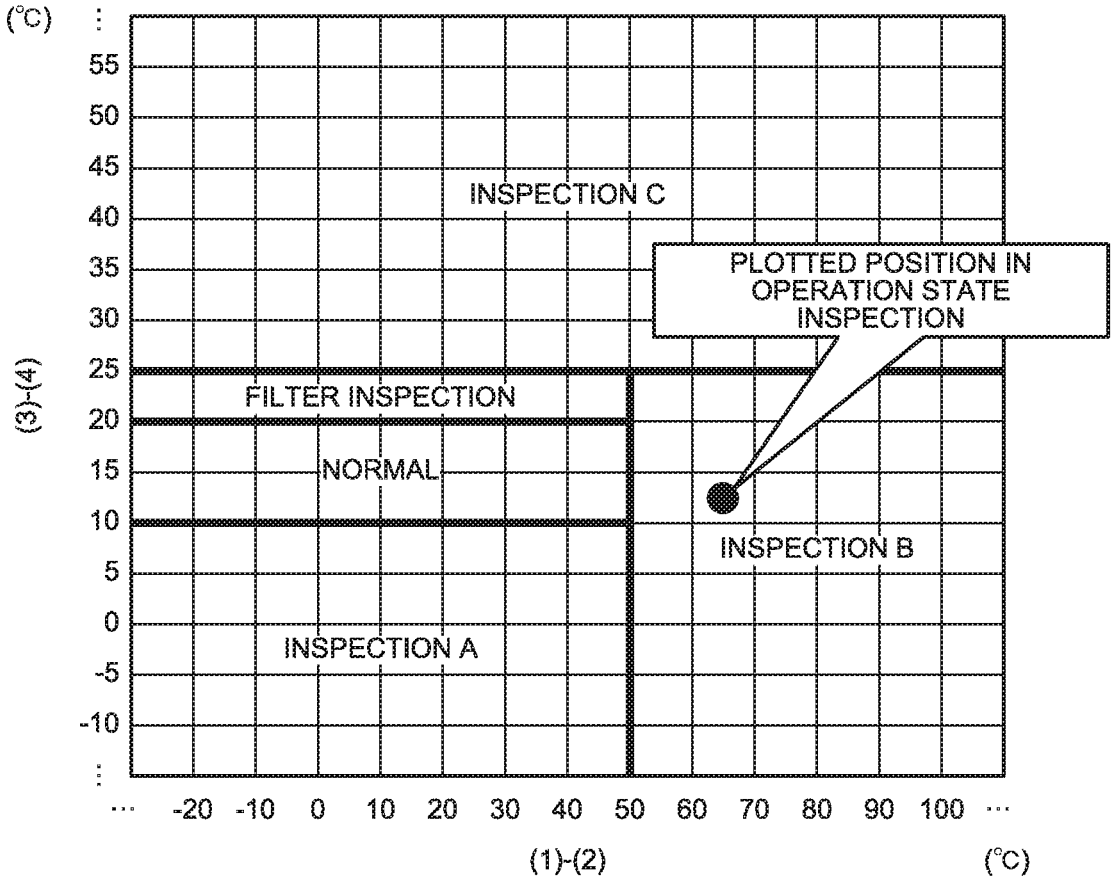
FIG. 13 is a diagram illustrating an example of an operation-state diagnosing table on which a result of the operation state diagnosing by the remote controller is plotted in the second embodiment.

FIG. 13 is a diagram illustrating an example of an operation-state diagnosing table on which a result of the operation state diagnosing by the remote controller at S22 is plotted. In FIG. 13, it is displayed that the result of the operation state diagnosing is out of a normal range and inspection B needs to be performed. However, the detailed inspection at S24 shows that inspection B is not necessary and the operation state is actually normal. Therefore, the remote controller 10 performs correction of the operation-state diagnosing table.

Figure 14:
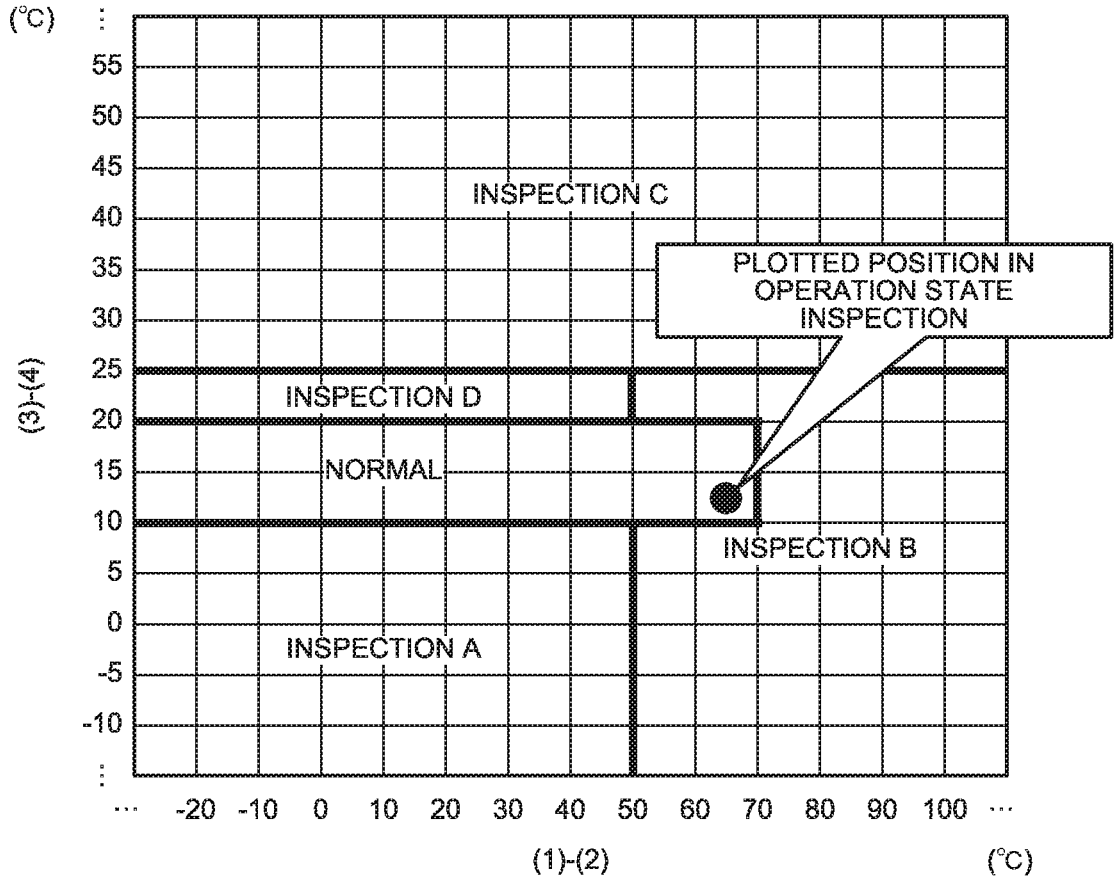
FIG. 14 is a diagram illustrating an example of the operation-state diagnosing table corrected in the second embodiment.

FIG. 14 is a diagram illustrating an example of the operation-state diagnosing table corrected at S27. In FIG. 14, the result of the operation state diagnosing falls within the normal range due to the correction of the operation-state diagnosing table.

As described above, the operation-state diagnosing tables stored in the memory of the remote controller can be corrected according to the installation environment and the operation situation.

The configurations described in the above embodiments are examples describing the substance of the present invention and can be combined with other known techniques. A part of the configurations can be omitted or modified without departing from the spirit of the present invention.

The invention claimed is:

1. A remote controller of an air-conditioning system including an outdoor device, and an indoor device connected to the outdoor device, the remote controller comprising:

a microcomputer; and a memory, wherein the memory that has stored therein, for each operation mode of the air-conditioning system, a plurality of operation-state diagnosing tables each corresponding to a different amount of operation time, each of the operation-state diagnosing tables are used for extracting necessary inspection items from an operation state in maintenance and inspection of the air-conditioning system, the microcomputer is configured to perform bidirectional wired or wireless communication with the indoor device to collect operation information including an operation time of the air-conditioning system;

select and use an appropriate one of the operation-state diagnosing tables according to an operation mode of the air-conditioning system and the operation time of the air-conditioning system, wherein at least one of the operation-state diagnosing tables indicates an area therein corresponding to a normal operation range of the air-conditioning system, the microcomputer is further configured to receive a correction to the area corresponding to the normal operation range and store the corrected at least one of the operation-state diagnosing tables.

2. The remote controller of the air-conditioning system according to claim 1, wherein the microcomputer is further configured to determine whether current operation times of the indoor device and the outdoor device are equal to or less than set operation-time threshold values, respectively, and automatically switch one of the operation-state diagnosing tables stored in the memory based on a result of the determination.

3. The remote controller of the air-conditioning system according to claim 1, wherein the microcomputer is further configured to control operation of the outdoor device and the indoor device.

4. An air-conditioning system with remote controller comprising:

the air conditioning system; and the remote controller, the air-conditioning system including an outdoor device; and an indoor device connected to the outdoor device, the remote controller is configured to be connected to the air-conditioning system, the remote controller comprising:

a microcomputer; and a memory, wherein the memory that has stored therein, for each operation mode of the air-conditioning system, a plurality of operation-state diagnosing tables each corresponding to a different amount of operation time, each of the operation-state diagnosing tables are used for extracting necessary inspection items from an operation state in maintenance and inspection of the air-conditioning system, the microcomputer is configured to perform bidirectional wired or wireless communication with the indoor device to collect operation information including an operation time of the air-conditioning system;

select and use an appropriate one of the operation-state diagnosing tables according to an operation mode of the air-conditioning system and the operation time of the air-conditioning system, wherein at least one of the operation-state diagnosing tables indicates an area therein corresponding to a normal operation range of the air-conditioning system, the microcomputer is further configured to receive a correction to the area corresponding to the normal operation range and store the corrected at least one of the operation-state diagnosing tables.

5. The air-conditioning system with remote controller according to claim 4, wherein the microcomputer is further configured to determine whether current operation times of the indoor device and the outdoor device are equal to or less than set operation-time threshold values, respectively, and automatically switch one of the operation-state diagnosing tables stored in the memory based on a result of the determination.

6. The air-conditioning system with remote controller according to claim 4, wherein the microcomputer is further configured to control operation of the outdoor device and the indoor device.

* * * * *